US005119725A

United States Patent [19]

Okamura

[11] Patent Number: 5,119,725

[45] Date of Patent: Jun. 9, 1992

[54] WEB PAPER CUTTING POSITION ADJUSTING SYSTEM

[75] Inventor: Yuichi Okamura, Tokyo, Japan

[73] Assignee: Kabushiki Kaisha Tokyo Kikai Seisakusho, Tokyo, Japan

[21] Appl. No.: 667,553

[22] Filed: Mar. 11, 1991

[30] Foreign Application Priority Data

Jun. 13, 1990 [JP] Japan ..... 2-154948

[51] Int. Cl.[5] ..... B41F 13/56

[52] U.S. Cl. ..... 101/226; 226/45; 226/91; 226/2; 318/603; 250/548; 364/471

[58] Field of Search ..... 101/226, 224, 227, 219, 101/181, 248; 226/12, 45, 91, 2; 235/475; 318/603; 250/548; 364/469, 471

[56] References Cited

U.S. PATENT DOCUMENTS

| | | | |
|---|---|---|---|
| 3,869,983 | 3/1975 | Garber et al. | 101/227 |
| 4,366,753 | 1/1983 | Glanz et al. | 101/227 |
| 4,538,515 | 9/1985 | Tymkewicz et al. | 364/469 |
| 4,541,337 | 9/1985 | Schaul | 101/227 |
| 4,706,566 | 11/1987 | Kishine et al. | 101/226 |
| 4,892,426 | 1/1990 | Steele | 250/548 |
| 4,896,605 | 1/1990 | Schroder | 101/227 |
| 5,052,295 | 10/1991 | Suzuki et al. | 226/92 |
| 5,052,296 | 10/1991 | Shibi | 101/227 |

OTHER PUBLICATIONS

Newspaper printing (revised) issued on Oct. 31, 1980, edited by the Japanese Newspaper Association, pp. 61.

*Primary Examiner*—Eugene H. Eickholt
*Attorney, Agent, or Firm*—Trexler, Bushnell, Giangiorgi & Blackstone, Ltd.

[57] ABSTRACT

Herein disclosed is a web paper cutting position adjusting system which comprises: marking means including a control unit for generating a predetermined phase detection signal by detecting a predetermined rotational phase of a platen, and a marking unit for marking a web paper in response to the predetermined phase detection signal; web paper cutting means disposed a predetermined distance downstream of the marking means for cutting the web paper; mark detecting means interposed between the marking means and the web paper cutting means for detecting the mark to transmit a mark detection signal; cutting phase signal transmitting means associated with the operation of the web paper cutting means for transmitting a cutting phase signal; and web paper threading path changing means including an arithmetic unit having an operation signal transmitting unit made receptive of the mark detection signal and the cutting phase signal for transmiting a web paper threading path length changing signal, if the transmission timing of the mark detection signal is outside of a predetermined range for allowance of the cutting phase signal, and a web paper threading path length changing unit disposed upstream of the mark detecting means for changing the threading path length of the web paper in response to the web paper threading path length changing signal.

11 Claims, 1 Drawing Sheet

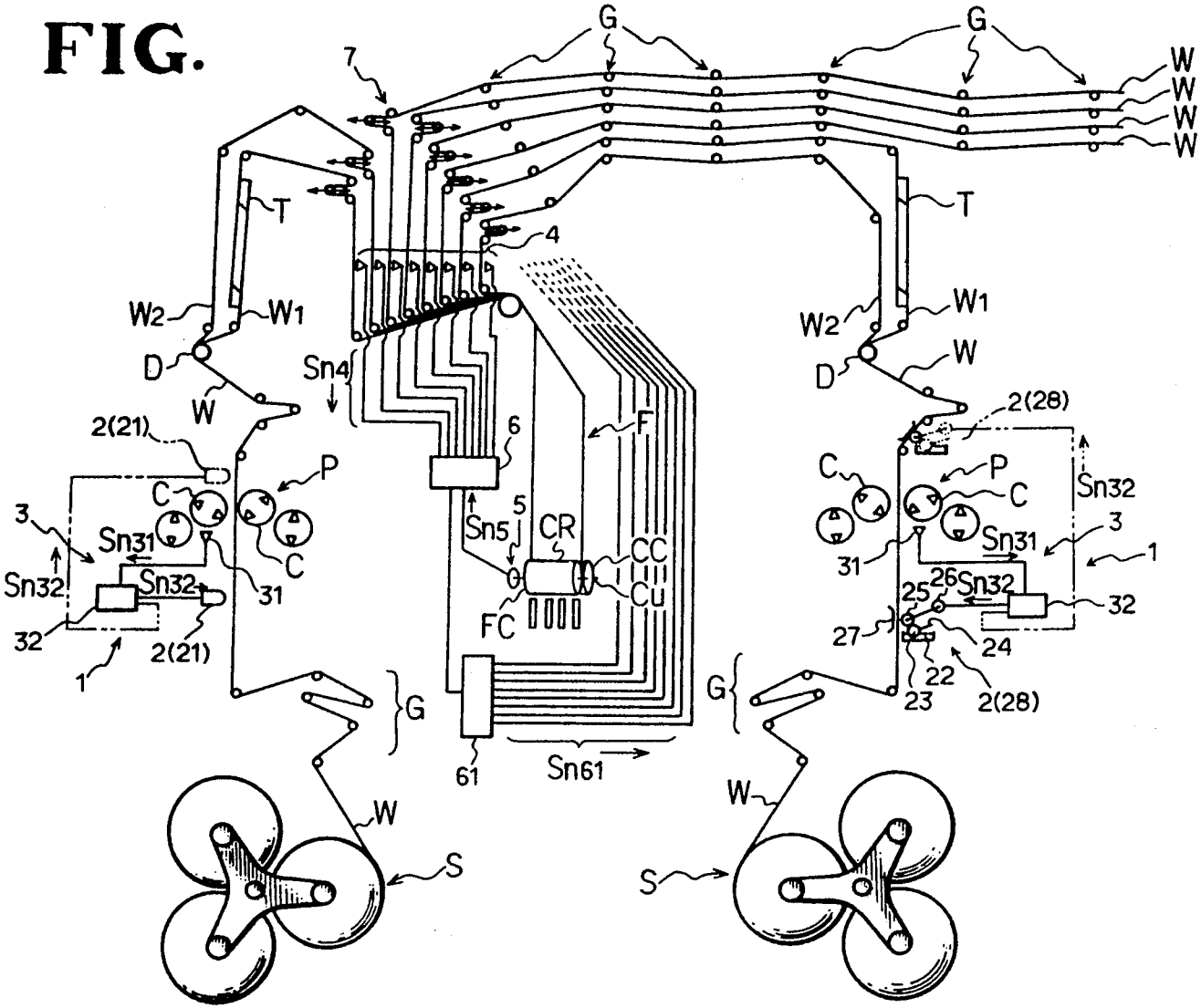
FIG.

WEB PAPER CUTTING POSITION ADJUSTING SYSTEM

BACKGROUND OF THE INVENTION

1. Field of the Invention

The present invention relates to a web paper cutting position adjusting system and, more particularly, to a system for changing and adjusting the relations of the printing and cutting positions on web paper in a web type offset rotary press.

2. Description of the Prior Art

In the offset rotary press, as is different from a relief rotary press, the web paper is threaded in the so-called "impression throwoff", in which the printing cylinders are thrown off from each other at the stage of preparing the printing of web paper. As a result, the printing of web paper is not performed at this paper threading stage before the start of actual printing. At this actual printing time, the relations between the printing and cutting positions on the web paper are clarified.

In the prior art, therefore, it is exclusively confirmed for each page whether or not the cut pieces discharged from the folded portions are cut in registration with the printed image. If any offset should be between the printing and cutting positions on the web paper, it is adjusted to a corresponding extent by running adjust rollers on the paper being threaded.

In the aforementioned case, according to the prior art, not only the web paper unprinted but threaded but also all the web papers having been threaded till the relations between the printing and cutting positions are adjusted are disposed as imperfections. Still the worse, the adjusting works take a long time to delay the printing works seriously.

SUMMARY OF THE INVENTION

The present invention contemplates to solve the above-specified problems and to provide a web paper cutting position adjusting system which is enabled to attain proper relations between the printing and cutting positions on the web paper before the actual run of printing thereby to achieve the drastic reduction of the imperfections and the drastic shorting of the adjusting time simultaneously.

According a primary feature of the present invention, there is provided a web paper cutting position adjusting system, which comprises: marking means including a control unit for generating a predetermined phase detection signal by detecting a predetermined rotational phase of a platen, and a marking unit for marking a web paper in response to said predetermined phase detection signal; web paper cutting means disposed a predetermined distance downstream of said marking means for cutting the web paper; mark detecting means interposed between said marking means and said web paper cutting means for detecting the mark to transmit a mark detection signal; cutting phase signal transmitting means associated with the operation of said web paper cutting means for transmitting a cutting phase signal; and web paper threading path changing means including an arithmetic unit having an operation signal transmitting unit made receptive of said mark detection signal and said cutting phase signal for transmitting a web paper threading path length changing signal, if the transmission timing of said mark detection signal is outside of a predetermined range for allowance of said cutting phase signal, and a web paper threading path length changing unit disposed upstream of said mark detecting means for changing the threading path length of the web paper in response to said web paper threading path length changing signal.

According to another feature of the present invention, there is provided A web paper cutting position adjusting system, which comprises: marking means including a control unit for generating a predetermined phase detection signal by detecting a predetermined rotational phase of a platen, and a marking unit for marking a web paper in response to said predetermined phase detection signal; web paper cutting means disposed a predetermined distance downstream of said marking means for cutting the web paper; and web paper threading path length changing means including a transmission unit disposed close to the discharge portion of said web paper cutting means, from which the cut pieces of paper are discharged, for transmitting a command signal, and a web paper threading path length changing unit disposed upstream of said web paper cutting means for changing the threading path length of the web paper in response to said command signal.

According still another feature of the present invention, said web paper threading path length changing unit includes a pair of guide rollers disposed up-stream of said mark detection means, and an adjust roller made remotely controllable with respect to said guide rollers.

When the threading works of the web paper are started in the offset rotary press, the web paper is guided and threaded between the printing cylinders in the impression throwoff position.

When the web paper is threaded between the printing cylinders, it is marked thereon on the basis of a predetermined rotational phase detection signal of the printing cylinders so that the mark always provides a constant phase in relation to the printed image in the printing operation.

The web paper thus marked is transferred to a folding portion along the paper threading path until it is cut into pieces by cutting means and is discharged to the outside. During the operation of this cutting means, a cutting phase signal is issued.

On the other hand, the aforementioned mark is detected by mark detecting means, which is disposed upstream of the cutting means, so that a mark detection signal is issued.

These mark detection signal and cutting phase signal are inputted to an arithmetic unit, and a web paper threading path length changing unit is run on the basis of an operation signal issued as a result of arithmetics, so that the mark on the web paper and the cutting position are automatically adjusted to a predetermined phase.

In case the mark on the web paper and the cutting position are to be manually adjusted to the predetermined phases, a transmission unit is disposed in the vicinity of folded pieces discharging unit. The transmission units issues a command signal, when the worker confirms a discrepancy between the mark on the folded pieces and the cut position, to adjust the discrepancy by operating the web paper threading path length changing unit on the basis of the command signal.

BRIEF DESCRIPTION OF THE DRAWING

The accompanying drawing is a schematic diagram showing the structure of a news paper printing offset rotary press which is equipped with a web paper cutting position adjusting system according to an embodiment of the present invention.

DESCRIPTION OF THE PREFERRED EMBODIMENT

The present invention will be described in the following in connection with an embodiment thereof with reference to the accompanying drawing.

In the news paper printing offset rotary press, paper feed units S, S, - - - , and so on support web paper W on a gin arm. A pair of printing cylinders C and C are opposed to printing units P, P, - - - , and so on. A folding unit F is equipped with a cutting cylinder, i.e., cutting means in which a serrated cylinder CC and a folding cylinder FC are paired. Paper threading paths connecting those individual portions are composed of a number of guide rollers G, G, - - - , and so on, drag rollers D, D, - - - , and so on, and turning bars T, T, - - - , and so on.

Marking means 1 is composed of a marking unit 2 for marking the web paper W, and a control unit 3 for controlling the mark by the marking unit 2 always in a constant phase in relation to the printed image when in the printing operation.

The marking unit 2 is exemplified by either the type of an ink injection nozzle 21 or the type of a marking device 28 which is composed of an ink reservoir 22, an ink feed roller 23, a doctor 24, a marking roller 25, a drive unit 26 and a receiving member 27. The marking unit 2 is further exemplified by either the type, in which two printing cylinders C of half length are juxtaposed widthwise of the web paper W, or the type in which printing cylinders of smaller width are suitably positioned widthwise of the web paper W. Moreover, the marking unit 2 may be positioned up-stream of the printing unit P, as indicated by solid lines, or downstream of the printing unit P, as indicated by double dotted lines.

The control unit 3 is composed of a predetermined rotational phase detecting unit 31 for holding the mark on the web paper W by the marking unit 2 always constant with respect to the printed image in the printing operation, and an operation signal transmitting unit 32 for transmitting a marking operation signal Sn32 to the marking unit 2 in response to a predetermined phase detection signal Sn31 coming from the detection unit 31.

The predetermined rotational phase detecting unit 31, as shown, is composed of a photoelectric sensor or a proximity sensor for transmitting the predetermined phase detection signal Sn31 each time the printing cylinder C rotates 180 degrees. The predetermined rotational phase detecting unit 31 may be exemplified by another suitable means such as a rotary encoder (although not shown) for transmitting the signal by detecting the rotational displacement of the printing cylinder C.

Moreover, the control unit 3 may be provided each at the righthand and lefthand sides in the axial direction for each printing cylinder C.

Mark detecting means 4 is exemplified by a reflection type photoelectric sensor which is disposed in the vicinity of the entrance of the folding unit F for detecting the mark formed on the web paper W by the marking unit 2, to transmit a mark detection signal Sn4.

Cutting phase signal transmitting unit 5 is a pulse generator for transmitting a pulse signal, i.e., a cutting phase signal Sn5 in association with the rotation of one of the paired cutting cylinders CC and FC, which are coactive in the folding unit F, namely, the rotation of the folding cylinder FC in the shown embodiment.

In response to the mark detection signal Sn4 coming from the mark detecting means 4 and the pulse signal or the cutting phase signal Sn5 coming from the cutting phase signal transmitting unit 5, arithmetic unit 6 resets and counts the number of the pulses of the cutting phase signal, each time the folding cylinder FC makes a half rotation, and extracts and compares the counted pulse number at the time of receiving the mark detection signal Sn4 with a preset input value thereby to decide whether or not the transmission timing of the mark detection signal Sn4 is within a predetermined allowable range of the cutting phase signal Sn5.

The arithmetic unit 6 may decide whether or not the mark detection signal Sn4 is transmitted during the transmission of predetermined continuous signals, by exemplifying the cutting phase signal transmitting unit 5 in place of the pulse generator by a (not-shown) signal transmitting unit for transmitting the continuous signals while the cutting cylinder is from one phase to another (while corresponding to the predetermined allowable range).

An operation signal transmitting unit 61 transmits a web paper threading path length changing signal Sn61 in case it is decided in the arithmetic unit 6 that the transmission timing of the mark detection signal Sn4 is outside of the predetermined allowable range of the cutting phase signal Sn5.

A web paper threading path length changing unit 7 is composed of a pair of guide rollers disposed up-stream of the mark detecting means 4, and adjust rollers made remotely controllable with respect to the guide rollers. In response to the web paper threading path length changing signal Sn61, the adjust rollers move a predetermined distance so that the mark on the web paper and the cutting position are changed and adjusted to a predetermined phase as a result of the movement. If this change is confirmed as a result of the arithmetic by the arithmetic unit 6, the transmission of the aforementioned changing signal Sn61 disappears.

The operations described above are directed to the case of automatic adjustment. In case of manual adjustment, however, the aforementioned mark detecting means 4, cutting phase signal transmitting unit 5 and arithmetic unit 6 are omitted, and the operation signal transmitting unit 61 is disposed in the vicinity of the web paper cutting means CC and FC. The worker observes the mark on the folded paper discharged from the folding unit F and the cutting position to know the relations of the two positions. If the mark is outside of an allowable range, the command signal Sn61 for the change and adjustment is transmitted from the operation signal transmitting unit 61 to the web paper threading path length changing unit 7.

The operations of the system of the present invention having the structure described above will be described in the following.

First of all, the web paper W is threaded from the feed unit S via the printing unit P to the folding unit F along the paper threading path of the guide roller groups G between the individual units. At this time, in the offset rotary press, the paired printing cylinders C and C are spaced in the impression throw-off state to thread the web paper W therethrough. As a result, the relations between the printing position on the web paper W and the cutting position are indefinite till the printing operation is started to perform the actual printing on the web paper.

In the present invention, therefore, the marking means 1 operating at the time of threading the paper into the printing cylinder C during the impression throwoff is provided to print a suitable mark on the web paper W in a position matching a predetermined phase of the printing cylinder C.

In the marking means 1, first of all, the predetermined rotational phase detecting unit 31 of the printing cylinder C detects one of (not-shown) markers, which are suitably positioned at a spacing of 180 degrees on the printing cylinder C, to transmit the predetermined phase detection signal Sn31.

In response to the predetermined phase detection signal Sn31, the operation signal transmitting unit 32 transmits the operation signal Sn32 to the marking unit 2 so that the marking unit 2 is brought into operation to mark one side of the web paper W.

At this time, the set position of the marking unit 2 and the rotational phase of the printing cylinder C are so associated that the marks to be applied to the web paper W by the operation of the marking unit 2 may always come to a constant position corresponding to an end portion or central portion of the printed image during the printing operation.

The marking operations of the marking unit 2 will be described in the following. In case the marking unit 2 is exemplified by the ink injection nozzle 21, it injects a proper amount of ink to the web paper W.

In case the marking unit 2 is exemplified by the marking device 28, the drive unit 26 operates to rotate the printing roller 25 one turn. In this meanwhile, the ink sucked from the ink reservior 22 by the circumference of the feed roller 23 associated with the printing roller 25 is adjusted to a proper amount by the doctor 24 and transferred to the printing roller 25.

This printing roller 25 has its circumference partially removed and its marking portion bulging. In the standby, the printing roller 25 has its removed portion facing the web paper W so that it is spaced from the web paper W by the gap between the receiving member 27 and the removed portion. However, the printing roller 25 clamps the web paper W, when it is rotated, between its marking portion and the receiving member 27 so that it marks the web paper W by transferring the ink from its printing portion. Alternatively, the printing roller 25 may have its whole circumference acting as the printing portion.

The receiving member 27 may be so suitably shaped as to clamp the web paper W in association with the printing roller 25.

The web paper W thus marked is conveyed to the folding unit F, in which it is cut and folded by the coactions of the serrated cylinder CC and the folding cylinder FC until its imperfections are discharged.

At this time, the cutting phase signal Sn5 from the cutting phase signal transmitting unit 5 associated with the rotations of the folding cylinder FC is inputted to the arithmetic unit 6. Each time the serrated cylinder CC and the folding cylinder FC reach the cutting phase, namely, at each half rotation of the folding cylinder FC, as has been described herein-before, the arithmetic unit 6 is reset to repeat the counting of the pulses of the cutting phase signal Sn5.

In this meanwhile, the web paper W thus marked at a predetermined pitch is conveyed along the paper path so that the marks are carried to and detected by the mark detecting means 4 which is disposed in the vicinity of the entrance of the folding unit F. Then, the mark detection signal Sn4 is transmitted and inputted to the arithmetic unit 6. This arithmetic unit 6 then extracts the counted value of the pulses and compares it with the predetermined numerical value which is set and inputted in advance to contain the allowable range. Thus, the arithmetic unit 6 decides whether or not the transmission timing of the mark detection signal Sn4 is within the range of said predetermined numeral value.

Here, this predetermined numerical value is set in the following manner, in case the marks fall at the end portions, i.e., the cut portions of the printed image during the printing operation and in case the constant of the number of pulses of the cutting phase signal Sn5 of the folding cylinder FC is reset each time the folding cylinder FC reaches the cutting phase.

Specifically, the predetermined numeral value is determined to the value which contains such an allowable error range as is prepared by replacing the length of the paper threading path from the position of the mark detecting means 4 to the meshing position of a serrated knife CU and a knife receiver CR during the cutting operation by the number of pulses of the cutting phase signal Sn5 corresponding to the circumferential length of the folding cylinder FC, and by setting a median to the "difference", which is prepared by subtracting the "residue" of the division of the replaced numeral value by the number of the pulses of the cutting phase signal Sn5 corresponding to the half rotation of the folding cylinder FC, from the number of the pulses corresponding to the half rotation of the folding cylinder FC.

If the counting in the arithmetic unit 6 is reset out of the cutting phase of the folding cylinder FC, the median is determined by adding or subtracting the number of pulses corresponding to the offset phase to or from said "difference". If, on the other hand, the marks are applied to the central portion of the printed image during the printing, the median is determined by adding or subtracting the number of pulses corresponding to a quarter rotation of the folding cylinder FC to or from said "difference". Like before, said predetermined numerical value is determined from the value containing the allowable error range by using the median thus determined.

In case the transmission timing of the mark detection signal Sn4 is decided by the arithmetic unit 6 to be outside of the predetermined allowable range of the cutting phase signal Sn5, the web paper threading path length changing signal Sn61 is transmitted from the operation signal transmitting unit 61. In response to this signal Sn61, the web paper threading path length changing unit 7 moves the adjust rollers a predetermined distance. The arithmetic unit 6 sequentially computes the results of those changes and adjustments. As a result, the transmission of the changing signal Sn61 disappears when it is recognized that the marks on the web paper and the cutting position are changed or adjusted to the predetermined phase.

The procedures of manual adjustment will be omitted because they have been touched hereinbefore.

In the offset rotary press incapable of obtaining an actual printed image on the web paper being threaded, according to the present invention, the marking is accomplished to establish such an effect as if a printed image were actually applied to the web paper, so that the relations of the positions of the marks and the cutting positions can be properly changed or adjusted before the actual printing operation by the web paper threading path length changing unit. As a result, the printing imperfections can be minimized. In addition, the change or adjustment can be made in advance, the adjusting time and troubles can be drastically reduced, as compared with the prior art in which the adjustment is performed during the actual printing operation.

What is claimed is:

1. A web paper cutting position adjusting system comprising:

marking means including a control unit for generating a predetermined phase detection signal by detecting a predetermined rotational phase of a platen, and a marking unit for marking a web paper in response to said predetermined phase detection signal;

web paper cutting means disposed a predetermined distance downstream of said marking means for cutting the web paper;

mark detecting means interposed between said marking means and said web paper cutting means for detecting the mark to transmit a mark detection signal;

cutting phase signal transmitting means associated with the operation of said web paper cutting means for transmitting a cutting phase signal; and web paper threading path changing means including an arithmetic unit having an operation signal transmitting unit made receptive of said mark detection signal and said cutting phase signal for transmitting a web paper threading path length changing signal, if the transmission timing of said mark detection signal is outside of a predetermined range for allowance of said cutting phase signal, and a web paper threading path length changing unit disposed upstream of said mark detecting means for changing the threading path length of the web paper in response to said web paper threading path length changing signal.

2. A web paper cutting position adjusting system according to claim 1, wherein the control means of said marking means includes a predetermined rotational phase detecting unit for holding the mark always in a constant phase with respect to a printed image to generate said predetermined phase detection signal, and an operation signal transmitting unit for transmitting a marking operation signal to said marking unit in response to said predetermined phase detection signal.

3. A web paper cutting position adjusting system according to claim 2, wherein the predetermined rotational phase detecting unit of said control means includes a photoelectric sensor or a proximity switch for transmitting said predetermined phase detecting signal each time a printing cylinder rotates a predetermined angle.

4. A web paper cutting position adjusting system according to claim 2, wherein the predetermined rotational phase detecting unit of said control means includes a rotary encoder for transmitting said predetermined phase detecting signal by detecting the rotational displacement of a printing cylinder.

5. A web paper cutting position adjusting system according to claim 1, wherein said web paper cutting means includes a cutting cylinder composed of a pair of serrated cylinder and folding cylinder disposed at a folding portion.

6. A web paper cutting position adjusting system according to claim 1, wherein said mark detecting means includes a reflection type photoelectric sensor for detecting the mark photoelectrically to transmit said mark detection signal.

7. A web paper cutting position adjusting system according to claim 1, wherein said cutting phase signal transmitting means includes a pulse generator for generating said cutting phase signal in the form of pulses.

8. A web paper cutting position adjusting system according cording to claim 1, wherein the operation signal transmitting unit of said arithmetic unit resets and counts the pulse number of said cutting phase signal at each time of a predetermined operation of said web paper cutting means and extracts and compares the pulse number with a preset value, in response to said mark detection signal, to decide whether or not the transmission timing of said mark detection signal is inside of said predetermined range for allowance of said cutting phase signal.

9. A web paper cutting position adjusting system according to claim 1, wherein said web paper threading path length changing unit includes a pair of guide rollers disposed upstream of said mark detection means, and an adjust roller made remotely controllable with respect to said guide rollers.

10. A web paper cutting position adjusting system according to claim 1 or 9, wherein said web paper threading path length changing unit includes a pair of guide rollers disposed upstream of said mark detection means, and an adjust roller made remotely controllable with respect to said guide rollers.

11. A web paper cutting position adjusting system comprising:

marking means including a control unit for generating a predetermined phase detection signal by detecting a predetermined rotational phase of a platen, and a marking unit for marking a web paper in response to said predetermined phase detection signal;

web paper cutting means disposed a predetermined distance downstream of said marking means for cutting the web paper; and web paper threading path length changing means including a transmission unit disposed close to the discharge portion of said web paper cutting means, from which the cut pieces of paper are discharged, for transmitting a command signal, and a web paper threading path length changing unit disposed upstream of said web paper cutting means for changing the threading path length of the web paper in response to said command signal.

* * * * *